US010449659B2

(12) United States Patent
Gollapudi et al.

(10) Patent No.: US 10,449,659 B2
(45) Date of Patent: Oct. 22, 2019

(54) ABRASIVE ARTICLE HAVING A CORE INCLUDING A COMPOSITE MATERIAL

(71) Applicants: SAINT-GOBAIN ABRASIVES, INC., Worcester, MA (US); SAINT-GOBAIN ABRASIFS, Conflans-Sainte-Honorine (FR)

(72) Inventors: Srikant Gollapudi, Chennai (IN); Naresh Saha, Chennai (IN); Adiseshaiah K. Sathyanarayanaiah, Chennai (IN)

(73) Assignees: SAINT-GOBAIN ABRASIVES, INC., Worcester, MA (US); SAINT-GOBAIN ABRASIFS, Conflans-Sainte-Honorine (FR)

( * ) Notice: Subject to any disclaimer, the term of this patent is extended or adjusted under 35 U.S.C. 154(b) by 98 days.

(21) Appl. No.: 15/223,306

(22) Filed: Jul. 29, 2016

(65) Prior Publication Data

US 2017/0028528 A1 Feb. 2, 2017

(30) Foreign Application Priority Data

Jul. 29, 2015 (IN) ..... 3888/CHE/2015

(51) Int. Cl.

| | |
|---|---|
| ***C09K 3/14*** | (2006.01) |
| ***B24D 3/00*** | (2006.01) |
| ***B24D 3/28*** | (2006.01) |
| ***B24D 3/06*** | (2006.01) |
| *B24D 3/02* | (2006.01) |
| *B24D 11/00* | (2006.01) |
| *B24D 18/00* | (2006.01) |
| *B24D 7/02* | (2006.01) |
| *B24D 5/02* | (2006.01) |

(52) U.S. Cl.

CPC ..... *B24D 3/28* (2013.01); *B24D 3/001* (2013.01); *B24D 3/06* (2013.01); *B24D 5/02* (2013.01); *B24D 7/02* (2013.01); *B24D 18/0009* (2013.01)

(58) Field of Classification Search

USPC ..... 51/298, 293, 307, 309

See application file for complete search history.

(56) References Cited

U.S. PATENT DOCUMENTS

| | | | |
|---|---|---|---|
| 3,830,020 | A | 8/1974 | Gomi |
| 3,868,232 | A | 2/1975 | Sioui et al. |
| 3,868,233 | A | 2/1975 | Carver et al. |

(Continued)

FOREIGN PATENT DOCUMENTS

| | | | |
|---|---|---|---|
| CN | 104625978 | A | 5/2015 |
| EP | 0344610 | A2 | 12/1989 |

(Continued)

OTHER PUBLICATIONS

International Search Report and Written Opinion for PCT Application No. PCT/US2016/044659, dated Nov. 7, 2016, 14 pages.

*Primary Examiner* — James E McDonough

(74) *Attorney, Agent, or Firm* — Abel Schillinger, LLP; Joseph P. Sullivan

(57) ABSTRACT

An abrasive article including a bonded abrasive body coupled to a core, the core includes a composite material including an organic material and a metallic material, and the composite material includes at least a first filler that can include nitrides, carbides, borides, oxides, silicates, or a combination thereof.

13 Claims, 4 Drawing Sheets

(56) References Cited

U.S. PATENT DOCUMENTS

| | | | | |
|---|---|---|---|---|
| 4,042,346 | A | 8/1977 | Sioui et al. | |
| 4,184,854 | A | 1/1980 | Sioui et al. | |
| 4,457,113 | A | 7/1984 | Miller | |
| 6,251,149 | B1 | 6/2001 | Meyer et al. | |
| 6,447,562 | B1 | 9/2002 | Sumiyoshi et al. | |
| 6,769,964 | B2 | 8/2004 | Tunstall | |
| 2009/0017736 | A1 | 1/2009 | Block et al. | |
| 2010/0159806 | A1 | 6/2010 | Wu et al. | |
| 2014/0187129 | A1* | 7/2014 | Sivasubramanian .... | B24D 3/04 451/541 |
| 2015/0183089 | A1* | 7/2015 | Iyengar ..... | B24D 11/00 451/28 |
| 2015/0343601 | A1* | 12/2015 | Serebrennikov ... | B24D 18/0009 451/541 |
| 2015/0375367 | A1* | 12/2015 | Sivasubramanian .... | B24D 3/28 51/296 |

FOREIGN PATENT DOCUMENTS

| | | | |
|---|---|---|---|
| EP | 0600977 | B1 | 7/1996 |
| EP | 1276593 | B1 | 8/2005 |
| WO | 9514553 | A1 | 6/1995 |
| WO | 2009009558 | A1 | 1/2009 |
| WO | 2017019942 | A1 | 2/2017 |

* cited by examiner

ABRASIVE ARTICLE HAVING A CORE INCLUDING A COMPOSITE MATERIAL

CROSS-REFERENCE TO RELATED APPLICATION

The present application claims priority under 35 U.S.C. § 119(a)-(d) to Indian Patent Application No. 3888/CHE/2015, filed Jul. 29, 2015, entitled "ABRASIVE ARTICLE HAVING A CORE INCLUDING A COMPOSITE MATERIAL," naming as inventors Srikant Gollapudi et al., which application is assigned to the current assignee hereof and is incorporated by reference herein in its entirety.

FIELD OF THE DISCLOSURE

The present disclosure relates to an abrasive article and in particular to an abrasive article having a core including a composite material.

BACKGROUND

The use of abrasive articles to contour and remove material from workpieces is well known. Such abrasive articles can include fixed abrasive articles, such as coated abrasives, bonded abrasives, and the like. The types of workpiece to be finished may determine the type of abrasive article that is used to conduct the material removal process.

In certain industries, bonded abrasives are used to finish and shape portions of glass, such as automotive glass, architectural glass, electronic glass, and the like. Such abrasive wheels may include abrasive particles contained in a bond material matrix, and may be used to shape the edges of glass workpieces. Certain prior art abrasive wheels are described in U.S. Pat. Nos. 3,830,020; 4,457,113; 6,769,964 and U.S. Publ. No. 20090017736. Commercial edge grinding wheels typically include a metal core and a bonded abrasive material bonded to the periphery of the metal core.

The industry continues to demand improved abrasive products.

SUMMARY

According to one aspect, an abrasive article includes a bonded abrasive body coupled to a core, wherein the core comprises a composite material including an organic material and a metallic material, and wherein the composite material includes at least a first filler selected from the group consisting of nitrides, carbides, borides, oxides, and a combination thereof.

According to another aspect, an abrasive article includes a bonded abrasive body coupled to a core, wherein the core comprises a composite material including an organic material and a metallic material, and wherein the core comprises a flexural strength of at least 60 MPa and a dampening factor of at least 0.007.

BRIEF DESCRIPTION OF THE DRAWINGS

The present disclosure may be better understood, and its numerous features and advantages made apparent to those skilled in the art by referencing the accompanying drawings.

DETAILED DESCRIPTION

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus.

As used herein, and unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Various embodiments of the present disclosure will now be described, by way of example only, with reference to the accompanying drawings.

Figure 1:
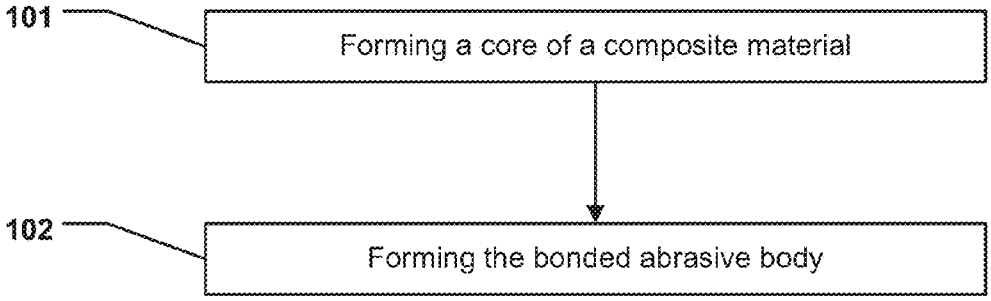
FIG. 1 includes a flow chart illustrating a method of making an abrasive article according to one embodiment.

FIG. 1 includes a flow chart providing a method of forming an abrasive article according to an embodiment. As illustrated, the process can be initiated by forming a core of a composite material. Various processes can be used to form the core, including but not limited to printing, deposition, pressing, molding, stamping, cutting, firing, heating, quenching, or a combination thereof. In at least one embodiment, the core can be formed by first forming a mixture including the raw materials of the composite material used to form the core. For example, in at least one embodiment, the mixture can include an organic material and a metallic material or precursors thereof, suitable for forming a core comprising a composite material including an organic material and a metallic material. The raw materials can be in the form of a powder or liquid. The mixture may be a wet mixture or dry mixture. One or more additives may be added to the mixture to facilitate suitable processing of the mixture into the core.

According to one embodiment, a mold can be provided having a suitable shape and size to facilitate formation of a core of the abrasive article. The mixture can be placed in the mold. In one embodiment, the mixture can include one or more powders of raw material, such as one or more resins (e.g., phenolic resin, novolac resin, or a combination thereof), cross-linking agents, and metal-containing raw material powders. In a more particular embodiment, the mixture can include a majority content by weight of a powder metal material (e.g., aluminum powder) and a minority content by weight of one or more resins (e.g., phenolic resin). The mixture may further include one or more fillers as described in the embodiments herein.

The mixture is then pressed within the mold to form a green body. Suitable pressing operations can include cold pressing or hot pressing. In at least one embodiment, the green body of the core can be formed by cold pressing the mixture in the mold at a range of temperatures between 90° C. to 200° C., using a force within a range between 4 MPa and 14 MPa for a duration within a range of 1 minute to 1 hour at the soaking temperature wherein the force is applied. The force can be initially applied at a lower temperature and held as the temperature is increased to the soak temperature.

After completing the pressing operation, the green body of the core is cured at a temperature of 90° C. to 200° C. for a duration of 6-15 hours. The core is cooled after curing to form a finally-formed core.

The process of forming the abrasive article can continue at step 102 by forming a bonded abrasive body. The bonded abrasive body may be formed from a mixture including abrasive particles, bond material or a bond material precursor, and optional additives, such as pore formers and the like. The bonded abrasive body can be formed to have various grades and structures, with varying contents and types of bond material, abrasive particles, and porosity suitable for the intended use of the bonded abrasive body. The bonded abrasive body can be attached to the core using an adhesive, a fastener, or various other methods known to those of skill in the art.

Figure 2:
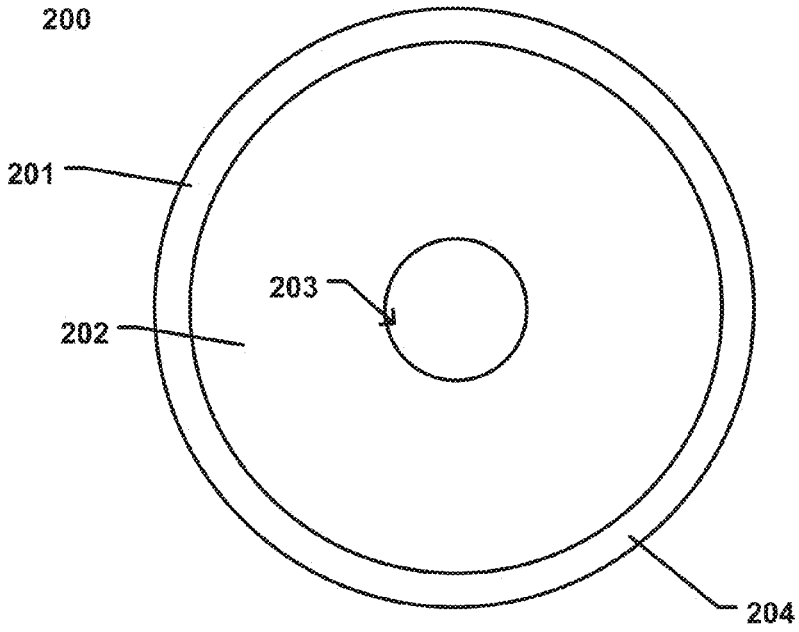
FIG. 2 includes a top-down image of an abrasive article according to an embodiment.

FIG. 2 includes a top-down illustration of the bonded abrasive article according to an embodiment. As illustrated, the abrasive article 200 can include a core 202 and a bonded abrasive body 204 attached to a peripheral surface of the core 202. The core 202 may also include an opening 203 that is sized to fit a spindle or arbor for rotation of the abrasive article 200 during a material removal operation.

In at least one embodiment, the core 202 can include a composite material including an organic material and a metallic material. In one embodiment, the organic material can include a polymer, such as a resin, and more particularly, a phenolic resin. According to one particular embodiment, the organic material can consist essentially of phenolic resin.

As noted herein, the core 202 can include a composite material including a metallic material, which may include a metal element or metal compound, such as a metal alloy, or a metal element containing compound. In one particular embodiment, the metallic material can include a metal selected from the group consisting of Al, Ga, Ge, Sc, Ti, V, Cr, Mn, Fe, Co, Ni, Cu, Zn, Ag, Ta, W, Ot, Au, Sn, Sb, or a combination thereof. In one particular embodiment, the metallic material can consist essentially of metal. More particularly, the metallic material can include aluminum, and in certain instances, may consist essentially of aluminum. Still, in another embodiment, the metallic material can include copper, and in certain instances, may consist essentially of copper.

For yet another embodiment, the metallic material of the core 202 may include a metal or metal alloy having a particular density, which can facilitate improved performance of the abrasive article. For example, the metallic material in the core 202 can have a density within a range of at least 1 g/cm$^3$ and not greater than 12 g/cm$^3$. More particularly, the density can be at least 1.2 g/cm$^3$, such as at least 1.5 g/cm$^3$ or at least 1.8 g/cm$^3$ or at least 2 g/cm$^3$ or at least 2.5 g/cm$^3$ or at least 2.6 g/cm$^3$. Still, in another non-limiting embodiment, the density of the metallic material can be not greater than 11 g/cm$^3$, such as not greater than 10 g/cm$^3$ or not greater than 9 g/cm$^3$ or not greater than 8 g/cm$^3$ or not greater than 7 g/cm$^3$ or not greater than 6 g/cm$^3$ or not greater than 5 g/cm$^3$ or not greater than 4 g/cm$^3$. It will be appreciated that the density of the metallic material can be within a range including any of the minimum and maximum values noted above.

In certain instances, the core 202 may have a particular density, which can facilitate improved performance of the abrasive article. For example, the core 202 can have a density within a range of at least 1 g/cm$^3$ and not greater than 12 g/cm$^3$. More particularly, the density can be at least 1.2 g/cm$^3$, such as at least 1.5 g/cm$^3$ or at least 1.8 g/cm$^3$ or at least 2 g/cm$^3$. Still, in another non-limiting embodiment, the density of the core can be not greater than 11 g/cm$^3$, such as not greater than 10 g/cm$^3$ or not greater than 9 g/cm$^3$ or not greater than 8 g/cm$^3$ or not greater than 7 g/cm$^3$ or not greater than 6 g/cm$^3$ or not greater than 5 g/cm$^3$ or not greater than 4 g/cm$^3$ or not greater than 3 g/cm$^3$ or not greater than 2.8 g/cm$^3$. It will be appreciated that the density of the core can be within a range including any of the minimum and maximum values noted above.

The core 202 can be formed such that it includes a majority content of the composite material. That is, the core can include a majority content (e.g., at least 51 wt % for the total weight of the core) of the composite material. In certain instances, the core 202 can include at least 60 wt % of the composite material for a total weight of the core, such as at least 70 wt % or at least 80 wt % or at least 90 wt % or at least 95 wt %. For one particular embodiment, the core can consist essentially of the composite material, such that the core is made entirely of the composite material.

According to one embodiment, the core can include a composite material having a particular flexural strength as measured according to ASTMC1161, which may facilitate improved performance of the core and/or abrasive article In one embodiment, the composite material can have a flexural modulus of at least 60 MPa, such as at least 65 MPa or at least 70 MPa or at least 75 MPa or at least 80 MPa or at least 85 MPa or at least 90 MPa or at least 95 MPa or at least 100 MPa or at least 105 MPa or at least 110 MPa or at least 115 MPa or even at least 120 MPa. Still, in another non-limiting embodiment, the flexural modulus of the composite material can be not greater than 200 MPa, such as not greater than 180 MPa, or even not greater than 160 MPa. It will be appreciated that the flexural modulus can be within a range including any of the minimum and maximum values noted above.

For yet another embodiment, the core can include a composite material having a particular dampening factor as measured according to ASTM E756, which may facilitate improved performance of the core and/or abrasive article In one embodiment, the composite material can have a dampening factor of at least wherein the core comprises a dampening factor of at least 0.007, such as at least 0.008 or at least 0.009 or at least 0.010 or at least 0.011 or at least 0.012 or at least or at least 0.013 or at least 0.014 or at least 0.015 or at least 0.016 or at least 0.017 or at least 0.018 or at least 0.019 or at least 0.02 or at least 0.021 or at least 0.022 or at least 0.023 or at least 0.025. In still another embodiment, the dampening factor can be not greater than 0.05 or not greater than 0.045 or not greater than 0.04 or not greater than 0.039 or not greater than 0.038 or not greater than 0.037 or not greater than 0.036 or not greater than 0.035 or not greater than 0.034 or not greater than 0.033 or not greater than 0.032 or not greater than 0.031 or not greater than 0.03 or not greater than 0.029 or not greater than 0.028 or not greater than 0.027 or not greater than 0.026. It will be appreciated that the dampening factor can be within a range including any of the minimum and maximum values noted above.

Figure 3:
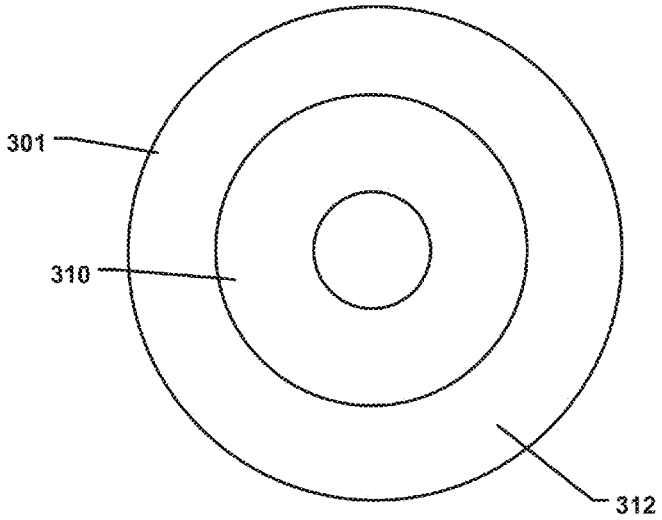
FIG. 3 includes a top-down image of a core according to an embodiment.

Still, in at least one alternative design, the core can include a first material including the composite material and a second material that is different from the first material including the composite material. In one instance, the first portion and second portion of the core can be are different in at least one parameter selected from the group consisting of size, shape, volume, radial position with respect to each other within the core, axial position with respect to each other within the core, or a combination thereof. FIG. 3 includes a top-down illustration of an alternative core according to an embodiment. As illustrated, the core 301 can include a first portion 310 and a second portion 312, wherein the first portion can include the first material and the second portion 312 can include the second material. It will be appreciated that FIG. 3 is included as merely illustrative of one arrangement of the first and second portions relative to each other and other arrangements are contemplated.

In one particular embodiment, the core can include a composite material having a certain content (wt %) of the organic material (Com), which may facilitate improved manufacturing and performance of the core and abrasive article. For example, the composite material can include at least 5 wt % of the organic material for a total weight of the composite material, such as at least 8 wt % or at least 10 wt % or at least 12 wt % or at least 15 wt % or at least 18 wt % or at least 20 wt % or at least 23 wt % or at least 25 wt % or at least 28 wt % or at least 30 wt % or at least 33 wt % or at least 35 wt % or at least 38 wt % or at least 40 wt %. Still, in another non-limiting embodiment, the composite material can include a content of the organic material (Com) of not greater than 50 wt % for the total weight of the composite material, such as not greater than 48 wt % or not greater than 45 wt % or not greater than 43 wt % or not greater than 40 wt % or not greater than 38 wt % or not greater than 35 wt % or not greater than 33 wt % or not greater than 30 wt % or not greater than 28 wt % or not greater than 25 wt % or not greater than 23 wt % or not greater than 20 wt % or not greater than 18 wt % or not greater than 15 wt % or not greater than 13 wt % or not greater than 10 wt %. It will be appreciated that the content (wt %) of organic material in the composite material can be within a range including any of the minimum and maximum percentages noted above.

In one particular embodiment, the core can include a composite material having a certain content (vol %) of the organic material (Com), which may facilitate improved manufacturing and performance of the core and abrasive article. For example, the composite material can include at least 10 vol % of the organic material for a total volume of the composite material, such as at least 12 vol % or at least 15 vol % or at least 18 vol % or at least 20 vol % or at least 23 vol % or at least 25 vol % or at least 28 vol % or at least 30 vol % or at least 33 vol % or at least 35 vol % or at least 38 vol % or at least 40 vol % or at least 43 vol % or at least 45 vol % or at least 48 vol % or at least 50 vol %. Still, in another non-limiting embodiment, the composite material can include a content (vol %) of the organic material (Com) of not greater than 65 vol % for the total weight of the composite material, such as not greater than 60 vol % or not greater than 58 vol % or not greater than 55 vol % or not greater than 53 vol % or not greater than 50 vol % or not greater than 48 vol % or not greater than 45 vol % or not greater than 43 vol % or not greater than 40 vol % or not greater than 38 vol % or not greater than 35 vol % or not greater than 33 vol % or not greater than 30 vol % or not greater than 28 wt % or not greater than 25 vol % or not greater than 23 vol % or not greater than 20 vol %. It will be appreciated that the content (vol %) of organic material (vol %) in the composite material can be within a range including any of the minimum and maximum percentages noted above.

In one particular embodiment, the core can include a composite material having a certain content (wt %) of the metallic material (Cmm), which may facilitate improved manufacturing and performance of the core and abrasive article. For example, the composite material can include at least 45 wt % of the metallic material for a total weight of the composite material, such as at least 48 wt % or at least 50 wt % or at least 52 wt % or at least 55 wt % or at least 58 wt % or at least 60 wt % or at least 63 wt % or at least 65 wt % or at least 68 wt % or at least 70 wt % or at least 73 wt % or at least 75 wt % or at least 78 wt % or at least 80 wt %. Still, in another non-limiting embodiment, the composite material can include a content (wt %) of the metallic material (Cmm) of not greater than 95 wt % for the total weight of the composite material, such as not greater than 93 wt % or not greater than 90 wt % or not greater than 88 wt % or not greater than 85 wt % or not greater than 53 wt % or not greater than 80 wt % or not greater than 78 wt % or not greater than 75 wt % or not greater than 73 wt % or not greater than 70 wt % or not greater than 68 wt % or not greater than 65 wt % or not greater than 63 wt % or not greater than 60 wt % or not greater than 58 wt % or not greater than 55 wt %. It will be appreciated that the content (wt %) of the metallic material in the composite material can be within a range including any of the minimum and maximum percentages noted above.

In one particular embodiment, the core can include a composite material having a certain content (vol %) of the metallic material (Cmm), which may facilitate improved manufacturing and performance of the core and abrasive article. For example, the composite material can include at least 30 vol % of the metallic material for a total volume of the composite material, such as at least 35 vol % or at least 38 vol % or at least 40 vol % or at least 43 vol % or at least 45 vol % or at least 48 vol % or at least 50 vol % or at least 53 vol % or at least 55 vol % or at least 58 vol % or at least 60 vol % or at least 63 vol % or at least 65 vol % or at least 68 vol % or at least 70 vol % or at least 73 vol % or at least 75 vol %. Still, in another non-limiting embodiment, the composite material can include a content (vol %) of the metallic material (Cmm) of not greater than 85 vol % for the total weight of the composite material, such as not greater than 80 vol % or not greater than 78 vol % or not greater than 75 vol % or not greater than 73 vol % or not greater than 70 vol % or not greater than 68 vol % or not greater than 65 vol % or not greater than 63 vol % or not greater than 60 vol % or not greater than 68 vol % or not greater than 65 vol % or not greater than 63 vol % or not greater than 50 vol % or not greater than 58 vol % or not greater than 55 vol % or not greater than 53 vol % or not greater than 50 vol % or not greater than 48 vol % or not greater than 45 vol %. It will be appreciated that the content of metallic material (vol %) in the composite material can be within a range including any of the minimum and maximum percentages noted above.

In certain instances, the composite material of the core 202 can include a particular ratio of the metallic material and the organic material that may facilitate improvement in manufacturing and/or performance of the core and/or abrasive article. For example, the composite material can include a content of the metallic material (Cmm) and a content of the organic material (Com) present in a weight percent ratio (Cmm/Com) of at least 1, such as at least 1.1 or at least 1.2 or at least 1.3 or at least 1.4 or at least 1.5 or at least 1.6 or at least 1.7 or at least 1.8 or at least 1.9 or at least 2 or at least 2.5 or at least 3 or at least 3.5 or at least 4 or at least 4.5 or at least 5 or at least 5.5 or at least 6 or at least 6.5 or at least 7 or at least 7.5 or at least 8 or at least 8.5 or at least 9 or at least 9.5 or even at least 10. Still, in another non-limiting embodiment, the weight percent ratio (Cmm/Com) can be not greater than 10, such as not greater than 9 or not greater than 8 or not greater than 7 or not greater than 6 or not greater than 5 or not greater than 4 or not greater than 3.5 or not greater than 3 or not greater than 2.8 or not greater than 2.5 or not greater than 2 or not greater than 1.8 or not greater than 1.5. It will be appreciated that the weight percent ratio (Cmm/Com) can be within a range including any of the minimum and maximum values noted above.

According to yet another embodiment, the composite material of the core 202 can include a particular ratio of the metallic material and the organic material that may facilitate improvement in manufacturing and/or performance of the core and/or abrasive article. For example, the composite material can include a content of the metallic material (Cmm) and a content of the organic material (Com) present in a weight percent ratio (Com/Cmm) of at least 0.7, such as at least 0.8 or at least 0.9 or at least 1 or at least 1.1 or at least 1.2 or at least 1.3 or at least 1.4 or at least 1.5 or at least 1.6 or at least 1.7 or at least 1.8 or at least 1.9 or at least 2 or at least 2.5 or at least 3 or at least 3.5 or at least 4 or at least 4.5 or at least 5 or at least 5.5 or at least 6 or at least 6.5 or at least 7 or at least 7.5 or at least 8 or at least 8.5 or at least 9 or at least 9.5 or even at least 10. Still, in another non-limiting embodiment, the weight percent ratio (Com/Cmm) can be not greater than 10, such as not greater than 9 or not greater than 8 or not greater than 7 or not greater than 6 or not greater than 5 or not greater than 4 or not greater than 3.5 or not greater than 3 or not greater than 2.8 or not greater than 2.5 or not greater than 2 or not greater than 1.8 or not greater than 1.5 or not greater than 1.2 or not greater than 1.1 or not greater than 1 or not greater than 0.9. It will be appreciated that the weight percent ratio (Com/Cmm) can be within a range including any of the minimum and maximum values noted above.

In one aspect, the core 202, and particularly, the composite material of the core 202 can include at least a first filler, which may facilitate improvement in manufacturing and/or performance of the core and/or abrasive article. The first filler can be selected from the group of nitrides, carbides, borides, oxides, silicates or a combination thereof. In certain instances, the first filler can be a polycrystalline material, and more particularly, may consist essentially of a polycrystalline material. In a more particular embodiment, the first filler may include a material selected from the group of a silicate, a carbide, or a combination thereof. For at least one embodiment, the first filler may include calcium. For example, the first filler may include a calcium silicate compound. In another aspect, the first filler may include an inosilicate compound. For example, the first filler may include wollastonite, and in certain instances, may consist essentially of wollastonite.

In yet another aspect, the first filler can include silicon, such as a silicon-containing compound, including for example, silicon carbide. In at least one embodiment, the first filler can consist essentially of silicon carbide.

In at least one embodiment, the first filler can be present in the core in a first content (Cff), which may facilitate suitable manufacturing and/or performance of the core and/or abrasive article. For example, the first filler may be present in a first content (Cff), which can be a minority content (i.e., less than 50 wt %) for a total weight of the core. According to one embodiment, the first content (Cff) can be not greater than 40 wt %, such as not greater than 38 wt % or not greater than 35 wt % or not greater than 33 wt % or not greater than 30 wt % or not greater than 28 wt % or not greater than 25 wt % or not greater than 23 wt % or not greater than 20 wt % or not greater than 18 wt % or not greater than 15 wt % or not greater than 13 wt % not greater than 10 wt % or not greater than 8 wt % or not greater than 6 wt % or not greater than 5 wt % or not greater than 4 wt % or not greater than 3 wt % or even not greater than 2 wt %. Still, in one non-limiting embodiment, the first content (Cff) can be at least at least 1 wt % for a total weight of the core, such as at least 2 wt % or at least 3 wt % or at least 4 wt % or at least 5 wt % or at least 6 wt % or at least 8 wt % or at least 10 wt % or at least 12 wt % or at least 15 wt % or at least 18 wt % or at least 20 wt % or at least 22 wt % or at least 25 wt % or even at least 28 wt %. It will be appreciated that the content (wt %) of organic material in the composite material can be within a range including any of the minimum and maximum percentages noted above.

In certain non-limiting embodiments, the core 202, and more particularly the composite material, can be free of certain materials. For example, in one embodiment, the composite material may be free of a glass material. Moreover, the core 202 may be free of a glass material. More particularly, in one non-limiting example, the core can be essentially free of glass fibers. In still another embodiment, the composite material can be essentially free of glass fibers. Still, it will be appreciated that in some instances, the core or composite material may include a glass material, such as glass fibers.

The first filler can have an average particle size which may facilitate improved manufacturing and/or performance of the core and/or abrasive article. For example, the first filler can have an average size less than about 2000 μm, such as less than about 1000 μm or less than about 500 μm or less than about 300 μm or less than about 200 μm or less than about 100 μm or less than about 80 μm or less than about 60 μm or less than about 40 μm or less than about 20 μm. In another non-limiting embodiment, the first filler can have an average particle size of at least 0.01 μm, such as at least 0.1 μm, at least about 1 μm, at least 5 μm or at least 10 μm. It will be appreciated that the average particle size of the first filler can be within a range including any of the minimum and maximum values noted above. The average particle size of elongated particles or fibers is based on the dimension of length.

Certain other suitable filler materials that may be included in the core and notably the composite material, which may be present as secondary fillers in addition to the first filler, and notably the composite material, may include other fibers and/or a powders. The secondary fillers may include, for example, glass fibers, carbon fibers, ceramic fibers, organic fibers, synthetic fibers (e.g., nylon, PTFE, polyester, and the like) minerals (e.g., fibers and/or particulate), talc or a combination thereof.

In at least one embodiment, the composite material of the core can include a first filler can be present in the core in a first content (Cff) as measured in volume percent and a content of the organic material (Com) as measured in volume percent. The composite material may include a particular relationship in the volume percent contents of the first filler and organic material, which may facilitate suitable manufacturing and/or performance of the core and/or abrasive article. For example, the composite material may include a volume percent ratio (Com/Cfm) of at least 0.1, such as at least 0.2 or at least 0.3 or at least 0.4 or at least 0.5 or at least 0.6 or at least 0.7 or at least 0.8 or at least 0.9 or at least 1 or at least 1.1 or at least 1.2 or at least 1.3 or at least 1.4 or at least 1.5 or at least 1.6 or at least 1.7 or at least 1.8 or at least 1.9 or at least 2 or at least 2.5 or at least 3 or at least 3.5 or at least 4 or at least 4.5 or at least 5 or at least 5.5 or at least 6 or at least 6.5 or at least 7 or at least 7.5 or at least 8 or at least 8.5 or at least 9 or at least 9.5 or even at least 10. Still, in another non-limiting embodiment, the volume percent ratio (Com/Cff) can be not greater than 10, such as not greater than 9 or not greater than 8 or not greater than 7 or not greater than 6 or not greater than 5 or not greater than 4 or not greater than 3.5 or not greater than 3 or not greater than 2.8 or not greater than 2.5 or not greater than 2 or not greater than 1.8 or not greater than 1.5 or not greater than 1.2 or not greater than 1.1 or not greater than 1 or not greater than 0.9 or not greater than 0.8 or not greater than 0.7 or not greater than 0.6 or not greater than 0.5 or not greater than 0.4 or not greater than 0.3. It will be appreciated that the volume percent ratio (Com/Cff) in the composite material can be within a range including any of the minimum and maximum percentages noted above.

The core 202 and the bonded abrasive body 204 can be directly or indirectly coupled together. In one embodiment, the core 202 and the bonded abrasive body 204 can be joined together by friction, which may not necessarily include cohesive bonding or mechanical fasteners. In another aspect, the bonded abrasive body 204 may be attached to the core 202 with an adhesive. In a further embodiment, the bonded abrasive body and the core may comprise a coupling connection, which may be in the form of a mechanical interlock. In certain instances, the core can include a groove or depression, and at least a portion of the bonded abrasive can be contained within the depression. In at least one embodiment, the bonded abrasive body 204 can be bonded to the core using an adhesive, such as an epoxy.

According to one embodiment, the core 202 of the abrasive article 200 can represent a majority of the total volume of the abrasive article 200. For example, in one embodiment, the core can be at least about 60 vol % based on the total volume of the abrasive article, such as at least about 70 vol %, at least about 75 vol %, at least 80 vol % or at least 85 vol %. Still, in another non-limiting embodiment, the core may be not greater than about 99 vol % of the abrasive article, such as at not greater than about 97 vol %, not greater than about 95 vol %, or not greater than about 90 vol %. It will be appreciated that the volume percent of the core 202 of the abrasive article 200 based on the total volume of the abrasive article 200 can be within a range between any of the minimum and maximum values noted above, such as from about 65 vol % to about 99 vol %, from about 70 vol % to about 95 vol %, or from about 80 vol % to about 95 vol %.

The bonded abrasive body 204 can be disposed at the peripheral surface of the core 202 and can include abrasive particles fixed in a bond material. Suitable abrasive particles can include, for example, oxides, carbides, nitrides, borides, diamond, cubic boron nitride, silicon carbide, boron carbide, alumina, silicon nitride, tungsten carbide, zirconia, or a combination thereof. In a particular aspect, the abrasive particles of the bonded abrasive are diamond particles. In at least one embodiment, the abrasive particles can consist essentially of diamond.

The abrasive particles contained in the bonded abrasive body can have an average particle size suitable to facilitate particular grinding performance. For example, the abrasive particles can have a size less than about 2000 μm, such as less than about 1000 μm, less than about 500 μm, or less than about 300 μm. In another aspect, the abrasive particles can have a size of at least 0.01 μm, such as at least 0.1 μm, at least about 1 μm, at least 5 μm or at least 10 μm. It will be appreciated that the size of the abrasive particles contained in the bonded abrasive can be within a range between any of the minimum and maximum values noted above, such as from about 0.01 μm to about 2000 μm, from about 1 μm to about 500 μm, from about 5 μm to about 300 μm or from about 50 μm to about 150 μm.

The bond material of the bonded abrasive body 204 can include an inorganic material, an organic material, and a combination thereof. Suitable inorganic materials for the use as bond material may include metals, glass, glass-ceramics, or a combination thereof. For example, an inorganic bond material can include one or more metal compositions or elements such as Cu, Sn, Fe, W, WC, Co, or a combination thereof. Organic materials suitable for use as the bond material may include polymers, such as thermosets, thermoplastics, and a combination thereof. In one particular embodiment, the bond material can include a resin, such as phenolic resin.

The abrasive article of the present disclosure may be selected from a range of suitable sizes to facilitate efficient grinding depending upon the workpiece. In one embodiment, the abrasive article can include an abrasive wheel having a diameter of at least about 25 mm, such as at least about 30 mm or at least about 50 mm. In another embodiment, the wheel diameter may be not greater than 500 mm, such as not greater than 450 mm or not greater than 300 mm or not greater than 200 mm. It will be appreciated that the wheel diameter can be within a range between any of the minimum and maximum values noted above, such as from about 25 mm to about 500 mm, from about 50 mm to about 250 mm, or from about 25 mm to about 150 mm.

Many different aspects and embodiments are possible. Some of these aspects and embodiments are described below. After reading this specification, those skilled in the art will appreciate that these aspects and embodiments are only illustrative and do not limit the scope of the present invention. Embodiments may be in accordance with any one or more of the embodiments as listed below.

Embodiment 1

An abrasive article comprising: a bonded abrasive body coupled to a core, wherein the core comprises a composite material including an organic material and a metallic material, and wherein composite material includes at least a first filler selected from the group consisting of nitrides, carbides, borides, oxides, silicates, or a combination thereof.

Embodiment 2

An abrasive article comprising: a bonded abrasive body coupled to a core, wherein the core comprises a composite material including an organic material and a metallic material, and wherein the core comprises a flexural strength of at least 60 MPa and a dampening factor of at least 0.007.

Embodiment 3

The abrasive article of embodiment 2, wherein the composite material includes at least a first filler.

Embodiment 4

The abrasive article of any one of embodiments 1 and 3, wherein the first filler includes a polycrystalline material.

Embodiment 5

The abrasive article of any one of embodiments 1 and 3, wherein the first filler consists essentially of a polycrystalline material.

Embodiment 6

The abrasive article of any one of embodiments 1 and 3, wherein the first filler comprises a material selected from the group consisting of a silicate, a carbide, or a combination thereof.

Embodiment 7

The abrasive article of any one of embodiments 1 and 3, wherein the first filler comprises calcium.

Embodiment 8

The abrasive article of any one of embodiments 1 and 3, wherein the first filler comprises a calcium silicate compound.

Embodiment 9

The abrasive article of any one of embodiments 1 and 3, wherein the first filler comprises an inosilicate compound.

Embodiment 10

The abrasive article of any one of embodiments 1 and 3, wherein the first filler comprises wollastonite.

Embodiment 11

The abrasive article of any one of embodiments 1 and 3, wherein the first filler consists essentially of wollastonite.

Embodiment 12

The abrasive article of any one of embodiments 1 and 3, wherein the first filler comprises silicon.

Embodiment 13

The abrasive article of any one of embodiments 1 and 3, wherein the first filler comprises silicon carbide.

Embodiment 14

The abrasive article of any one of embodiments 1 and 3, wherein the first filler consists essentially of silicon carbide.

Embodiment 15

The abrasive article of any one of embodiments 1 and 3, wherein the first filler is present in a first content (Cff), and the core comprises a minority content of the first content for a total weight of the core.

Embodiment 16

The abrasive article of any one of embodiments 1 and 3, wherein the core comprises a first content within a range of at least 1 wt % and not greater than 30 wt %.

Embodiment 17

The abrasive article of any one of embodiments 1 and 2, wherein the core is essentially free of a glass material.

Embodiment 18

The abrasive article of any one of embodiments 1 and 2, wherein the core is essentially free of glass fibers.

Embodiment 19

The abrasive article of any one of embodiments 1 and 2, wherein the organic material comprises a polymer.

Embodiment 20

The abrasive article of any one of embodiments 1 and 2, wherein the organic material comprises a resin.

Embodiment 21

The abrasive article of any one of embodiments 1 and 2, wherein the organic material comprises phenolic resin.

Embodiment 22

The abrasive article of any one of embodiments 1 and 2, wherein the organic material consists essentially of phenolic resin.

Embodiment 23

The abrasive article of any one of embodiments 1 and 2, wherein the core includes a majority content of the composite material.

Embodiment 24

The abrasive article of any one of embodiments 1 and 2, wherein the core includes at least 60 wt % of the composite material for a total weight of the core or at least 70 wt % or at least 80 wt % or at least 90 wt % or at least 95 wt %.

Embodiment 25

The abrasive article of any one of embodiments 1 and 2, wherein the core consists essentially of the composite material.

Embodiment 26

The abrasive article of any one of embodiments 1 and 2, wherein the core comprises a first portion including the composite material and a second portion having a second material different than the composite material.

Embodiment 27

The abrasive article of embodiment 26, wherein the first portion and second portion are different in at least one parameter selected from the group consisting of size, shape, volume, radial position with respect to each other within the core, axial position with respect to each other within the core, or a combination thereof.

Embodiment 28

The abrasive article of any one of embodiments 1 and 2, wherein the composite material includes a content of the organic material (Com) within a range of at least about 5 wt % and not greater than 50 wt % for the total weight of the composite material.

Embodiment 29

The abrasive article of any one of embodiments 1 and 2, wherein the composite material includes a content of the organic material (Com) within a range of at least about 15 vol % and not greater than 60 vol % for the total weight of the composite material.

Embodiment 30

The abrasive article of any one of embodiments 1 and 2, wherein the metallic material comprises a metal or metal alloy.

Embodiment 31

The abrasive article of any one of embodiments 1 and 2, wherein the metallic material comprises a metal selected from the group consisting of Al, Ga, Ge, Sc, Ti, V, Cr, Mn, Fe, Co, Ni, Cu, Zn, Ag, Ta, W, Ot, Au, Sn, Sb, or a combination thereof.

Embodiment 32

The abrasive article of any one of embodiments 1 and 2, wherein the metallic material has a density within a range of at least 1 g/cm3 and not greater than 12 g/cm3.

Embodiment 33

The abrasive article of any one of embodiments 1 and 2, wherein the metallic material consists essentially of metal.

Embodiment 34

The abrasive article of any one of embodiments 1 and 2, wherein the metallic material comprises aluminum.

Embodiment 35

The abrasive article of any one of embodiments 1 and 2, wherein the metallic material consists essentially of aluminum.

Embodiment 36

The abrasive article of any one of embodiments 1 and 2, wherein the metallic material comprises copper.

Embodiment 37

The abrasive article of any one of embodiments 1 and 2, wherein the composite material includes a content of the metallic material (Cmm) within a range of at least about 50 wt % and not greater than 95 wt % for the total weight of the composite material.

Embodiment 38

The abrasive article of any one of embodiments 1 and 2, wherein the composite material includes a content of the metallic material (Cmm) within a range of at least about 40 vol % and not greater than 80 vol % for the total weight of the composite material.

Embodiment 39

The abrasive article of any one of embodiments 1 and 2, wherein the composite material includes a content of the metallic material (Cmm) and a content of the organic material (Com) and wherein the composite material comprises a weight percent ratio (Cmm/Com) of at least 1 or at least 1.1 or at least 1.2 or at least 1.3 or at least 1.4 or at least 1.5 or at least 1.6 or at least 1.7 or at least 1.8 or at least 1.9 or at least 2 or at least 2.5 or at least 3 or at least 3.5 or at least 4 or at least 4.5 or at least 5 or at least 5.5 or at least 6 or at least 6.5 or at least 7 or at least 7.5 or at least 8 or at least 8.5 or at least 9 or at least 9.5 or at least 10.

Embodiment 40

The abrasive article of any one of embodiments 1 and 2, wherein the composite material includes a content of the metallic material (Cmm) and a content of the organic material (Com) and wherein the composite material comprises a weight percent ratio (Cmm/Com) of not greater than 10 or not greater than 9 or not greater than 8 or not greater than 7 or not greater than 6 or not greater than 5 or not greater than 4 or not greater than 3.5 or not greater than 3 or not greater than 2.8 or not greater than 2.5 or not greater than 2 or not greater than 1.8 or not greater than 1.5.

Embodiment 41

The abrasive article of any one of embodiments 1 and 2, wherein the composite material includes a content of the metallic material (Cmm) and a content of the organic material (Com) and wherein the composite material comprises a volume percent ratio (Com/Cmm) of at least 0.7 or at least 0.8 or at least 0.9 or at least 1 or at least 1.1 or at least 1.2 or at least 1.3 or at least 1.4 or at least 1.5 or at least 1.6 or at least 1.7 or at least 1.8 or at least 1.9 or at least 2 or at least 2.5 or at least 3 or at least 3.5 or at least 4 or at least 4.5 or at least 5 or at least 5.5 or at least 6 or at least 6.5 or at least 7 or at least 7.5 or at least 8 or at least 8.5 or at least 9 or at least 9.5 or at least 10.

Embodiment 42

The abrasive article of any one of embodiments 1 and 2, wherein the composite material includes a content of the metallic material (Cmm) and a content of the organic material (Com) and wherein the composite material comprises a volume percent ratio (Com/Cmm) of not greater than 10 or not greater than 9 or not greater than 8 or not greater than 7 or not greater than 6 or not greater than 5 or not greater than 4 or not greater than 3.5 or not greater than 3 or not greater than 2.8 or not greater than 2.5 or not greater than 2 or not greater than 1.8 or not greater than 1.5 or not greater than 1.2 or not greater than 1.1 or not greater than 1 or not greater than 0.9.

Embodiment 43

The abrasive article of embodiment 2, wherein the core comprises at least a first filler selected from the group consisting of nitrides, carbides, borides, oxides, and a combination thereof.

Embodiment 44

The abrasive article of any one of embodiments 1 and 43, wherein the composite material includes a content of the metallic material (Cmm) and a content of the first filler (Cff) and wherein the composite material comprises a volume percent ratio (Cmm/Cfm) within a range of at least 0.5 and not greater than 10.

Embodiment 45

The abrasive article of any one of embodiments 1 and 43, wherein the composite material includes a content of the organic material (Com) and a content of the first filler (Cff) and wherein the composite material comprises a volume percent ratio (Com/Cfm) within a range of at least 0.5 and not greater than 10.

Embodiment 46

The abrasive article of any one of embodiments 1 and 2, further comprising an adhesive material coupling the bonded abrasive body to the core.

Embodiment 47

The abrasive article of embodiment 1, wherein the core comprises a dampening factor of at least 0.007.

Embodiment 48

The abrasive article of any one of embodiments 2 and 47, wherein the dampening factor is at least 0.008 or at least 0.009 or at least 0.010 or at least 0.011 or at least 0.012 or at least or at least 0.013 or at least 0.014 or at least 0.015 or at least 0.016 or at least 0.017 or at least 0.018 or at least 0.019 or at least 0.02 or at least 0.021 or at least 0.022 or at least 0.023 or at least 0.025.

Embodiment 49

The abrasive article of any one of embodiments 2 and 47, wherein the dampening factor is not greater than 0.05 or not greater than 0.045 or not greater than 0.04 or not greater than 0.039 or not greater than 0.038 or not greater than 0.037 or not greater than 0.036 or not greater than 0.035 or not greater than 0.034 or not greater than 0.033 or not greater than 0.032 or not greater than 0.031 or not greater than 0.03 or not greater than 0.029 or not greater than 0.028 or not greater than 0.027 or not greater than 0.026.

EXAMPLES

Example 1

Figure 4:
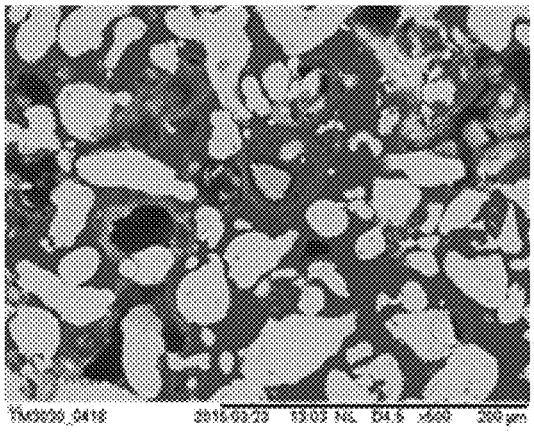
FIG. 4 includes an image of a portion of a core including a composite material according to an embodiment.

A first sample (S1) was formed by creating a mixture of 78-82 wt % alumina powder material available from Mepco Corporation and 18-22 wt % powder phenolic resin material available in powdered form from Westcoast Polymers, and a sufficient content of a cross-linking agent (e.g., hexamethylenetetramine) suitable for effectively cross-linking the resin material, such that a total content of the components in the mixture totals 100%. The mixture was placed in a mold and subject to a cold pressing operation including heating up to approximately 80-100° C. and the application of force within a range of 4 MPa to 14 MPa while heating continued to a soak temperature of approximately 150-180° C. and the force was maintained for approximately 4-10 minutes. The mixture was then cured in an oven set at approximately 200-215° C. for a duration of 10-12 hours. After curing, the molded core was cooled to room temperature. FIG. 4 includes a scanning electron microscope image of a portion of sample S1.

Figure 5:
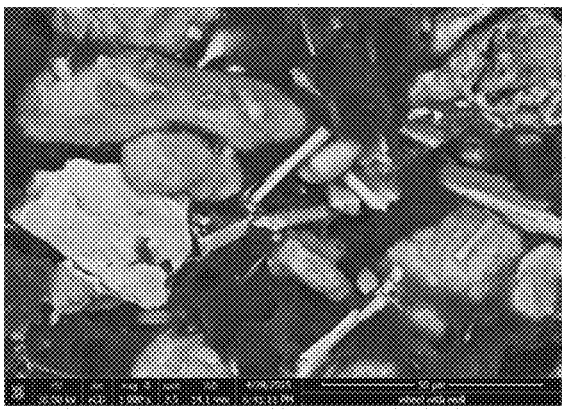
FIG. 5 includes an image of a portion of a core including a composite material according to an embodiment.

A second sample (S2) was formed in the same manner as sample S1, except that the core was formed to include approximately 78-82 wt % alumina powder material available from Mepco Corporation and 16-20 wt % powder phenolic resin material available in powdered form from Westcoast Polymers, a sufficient content of a cross-linking agent (e.g., hexamethylenetetramine) suitable for effectively cross-linking the resin material, and 3-6 wt % wollastonite in powdered form available from Wolchem. FIG. 5 includes a scanning electron microscope image of a portion of sample S2.

A third sample (S3) was formed in the same manner as sample S1, except that the core was formed to include approximately 78-82 wt % alumina powder material available from Mepco Corporation and 16-20 wt % powder phenolic resin material available in powdered form from Westcoast Polymers, a sufficient content of a cross-linking agent (e.g., hexamethylenetetramine) suitable for effectively cross-linking the resin material, and 3-6 wt % silicon carbide available as black SiC powder from Saint Gobain India.

A convention sample (SCon) of a grinding wheel commercially available as Norton (150-8.5-8-50-30) from Saint-Gobain Corporation was obtained. The SCon sample was a bonded abrasive wheel for finishing glass, having a metal core made of cast aluminum.

Sample S1 had an average flexural strength of approximately 60 MPa and a dampening factor of approximately 0.015. Sample S2 had an average flexural strength of approximately 136 MPa and a dampening factor of approximately 0.021. Sample S3 had an average flexural strength of approximately 123 MPa and a dampening factor of approximately 0.025. Sample SCon had an average flexural strength of approximately 160 MPa and a dampening factor of approximately 0.005.

Each of the sample wheels were tested in a glass grinding operation using a resin-bonded abrasive, at a line speed of 3 m/min and a depth of cut of 0.2 mm. The abrasive articles of Samples S2 and S3 demonstrated a wheel life that was equivalent to the conventional sample, SCon.

Example 2

A comparative sample (CS1) was formed by creating a mixture of 78-82 wt % alumina powder material available from Mepco Corporation and 18-22 wt % powder phenolic resin material available in powdered form from Westcoast Polymers, and a sufficient content of a cross-linking agent (e.g., hexamethylenetetramine) suitable for effectively cross-linking the resin material, such that a total content of the components in the mixture totals 100%. The mixture was placed in a mold and subject to a cold pressing operation including heating up to approximately 80-100° C. and the application of force within a range of 4 MPa to 14 MPa while heating continued to a soak temperature of approximately 150-180° C. and the force was maintained for approximately 4-10 minutes. The mixture was then cured in an oven set at approximately 200-215° C. for a duration of 10-12 hours. After curing, the molded core was cooled to room temperature. FIG. 4 includes a scanning electron microscope image of a portion of sample S1.

A sample S4 was formed in the same manner as sample S1, except that the core was formed to include approximately 78-82 wt % alumina powder material available from Mepco Corporation and 16-20 wt % powder phenolic resin material available in powdered form from Westcoast Polymers, a sufficient content of a cross-linking agent (e.g., hexamethylenetetramine) suitable for effectively cross-linking the resin material, and 3 wt % filler. The filler material was wollastonite in powdered form available from Wolchem.

A sample S5 was formed in the same manner as sample S1, except that the core was formed to include approximately 78-82 wt % alumina powder material available from Mepco Corporation and 16-20 wt % powder phenolic resin material available in powdered form from Westcoast Polymers, a sufficient content of a cross-linking agent (e.g., hexamethylenetetramine) suitable for effectively cross-linking the resin material, and 6 wt % filler. The filler material was wollastonite in powdered form available from Wolchem.

A sample S6 was formed in the same manner as sample S1, except that the core was formed to include approximately 78-82 wt % alumina powder material available from Mepco Corporation and 16-20 wt % powder phenolic resin material available in powdered form from Westcoast Polymers, a sufficient content of a cross-linking agent (e.g., hexamethylenetetramine) suitable for effectively cross-linking the resin material, and 9 wt % filler. The filler material was wollastonite in powdered form available from Wolchem.

A sample S7 was formed in the same manner as sample S1, except that the core was formed to include approximately 78-82 wt % alumina powder material available from Mepco Corporation and 16-20 wt % powder phenolic resin material available in powdered form from Westcoast Polymers, a sufficient content of a cross-linking agent (e.g., hexamethylenetetramine) suitable for effectively cross-linking the resin material, and 12 wt % filler. The filler material was wollastonite in powdered form available from Wolchem.

The flexural strength of each sample S4, S5, S6 and S7 and comparative sample CS1 was measured and is summarized in Table 1 below.

TABLE 1

Flexural Strength Comparison

| Sample | Flexural Strength (MPa) | Stdev. | Surface Roughness-Ra (μm) | Surface Roughness-Rz (μm) |
|---|---|---|---|---|
| CS1 | 53 | 3 | 0.6-0.8 | 4-5 |
| S4 | 125 | 6 | 0.6-0.8 | 4-5 |
| S5 | 92 | 4 | 0.6-0.8 | 4-5 |
| S6 | 81 | 3 | 0.6-0.8 | 4-5 |
| S7 | 64 | 4 | 1.2 | 7 |

Figure 6:
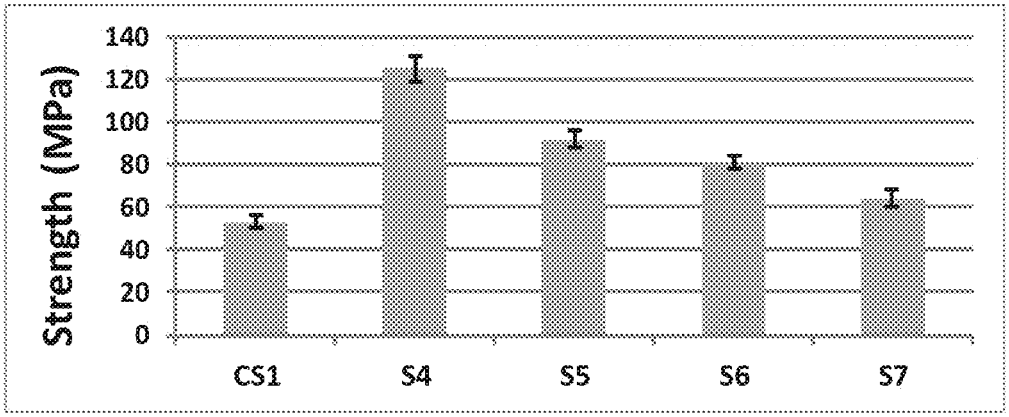
FIG. 6 includes a plot comparing the "Flexural Strength" of composite material samples according to embodiments and a comparative composite material sample.

FIG. 6 includes a plot of the "Flexural Strength" for each sample S4, S5, S6, S7 and comparative sample CS1. As shown in FIG. 1, sample S4 showed a flexural strength of nearly three times the flexural strength of comparative sample CS1, which has no filler material content. As further shown in FIG. 2, sample S4 showed a flexural strength of nearly two times the flexural strength of comparative sample S7.

Figure 7A:
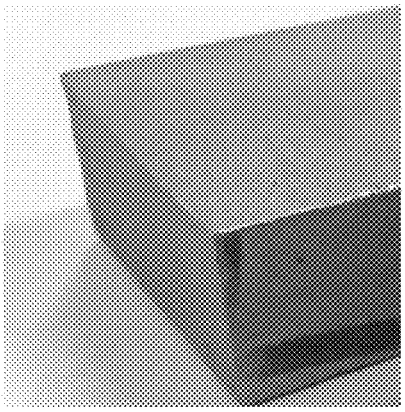
FIG. 7*a* includes an image of a portion of a composite material sample according to an embodiment.
Figure 7B:
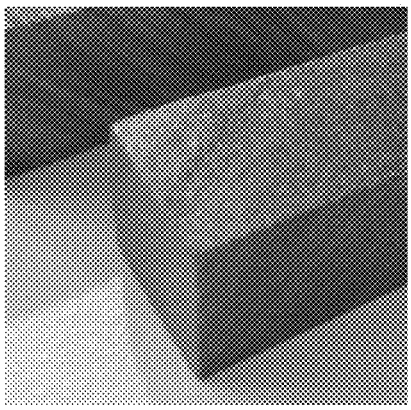
FIG. 7*b* includes an image of a portion of a composite material sample according to an embodiment.
Figure 7C:
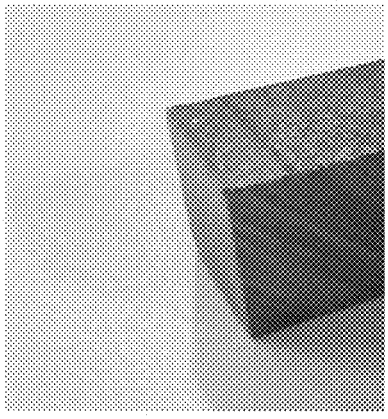
FIG. 7*c* includes an image of a portion of a composite material sample according to an embodiment.
Figure 7D:
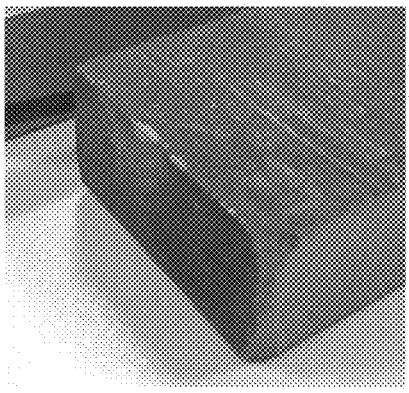
FIG. 7*d* includes an image of a portion of a composite material sample according to an embodiment.

FIG. 7*a* includes an image of sample S4. FIG. 7*b* includes an image of sample S5. FIG. 7*c* includes an image of sample S6. FIG. 7*d* includes an image of sample S7. The images of samples S4, S5, S6 and S7 were visually inspected to determine a general machinability rating. A general machinability rating is an indication of the ability of a material sample to be machined without forming chips, scratches or other imperfections in the surface of the sample. As shown in the images of samples S4, S5, S6 and S7, there is a decrease in the machinability rating (i.e., an increase in chips, scratches or other imperfections in the surface of the samples) as the amount of filler in the sample increase. Specifically, samples having less than 6 wt % filler material (i.e. samples S4 and S5) showed little to no chips, scratches or other imperfections in the surface of the sample and are thus described as having a relatively high machinability rating. Samples have greater than 6 wt % filler material (i.e., samples S6 and S7) showed an increase in the amount of chips, scratches and imperfections in the surface of the sample and are thus described as having a relative low machinability rating. In particular, samples having less than 6 wt % filler material (i.e. samples S4 and S5) can be described as having a higher machinability rating than sample having greater than 6 wt % filler material (i.e., samples S6 and S7).

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of the invention.

What is claimed is:

1. An abrasive article comprising:

a bonded abrasive body coupled to a core, wherein the core comprises a composite material including a mixture of an organic material, a metallic material, and a first filler, wherein the composite material includes a content of the metallic material (Cmm) and a content of the organic material (Com), wherein the composite material comprises a weight percent ratio Cmm/Com of at least 1, wherein the composite material comprises at least 45 wt. % of the metallic material, wherein the metallic material comprises a metal selected from the group consisting of Al, Ge, Sc, Ti, V, Cr, Mn, Co, Ni, Cu, Zn, Ag, Ta, W, Ot, Au, Sn, Sb, or a combination thereof, and wherein the first filler is selected from the group consisting of nitrides, carbides, borides, oxides, silicates, or a combination thereof.

2. The abrasive article of claim 1, wherein the first filler includes a polycrystalline material.

3. The abrasive article of claim 1, wherein the first filler consists essentially of a polycrystalline material.

4. The abrasive article of claim 1, wherein the first filler comprises a material selected from the group consisting of a silicate, a carbide, or a combination thereof.

5. The abrasive article of claim 1, wherein the first filler comprises wollastonite.

6. The abrasive article of claim 1, wherein the first filler consists essentially of wollastonite.

7. The abrasive article of claim 1, wherein the first filler comprises silicon carbide.

8. The abrasive article of claim 1, wherein the first filler is present in a first content (Cff), and the core comprises a minority content of the first content for a total weight of the core.

9. The abrasive article of claim 1, wherein the core comprises a first content within a range of at least 1 wt % and not greater than 30 wt %.

10. The abrasive article of claim 1, wherein the organic material comprises a polymer.

11. The abrasive article of claim 1, wherein the organic material comprises phenolic resin.

12. The abrasive article of claim 1, wherein the core includes at least 60 wt % of the composite material for a total weight of the core.

13. The abrasive article of claim 1, wherein the abrasive body comprises a dampening factor of at least 0.007.

* * * * *